US006435360B1

(12) United States Patent
Buchmeier

(10) Patent No.: US 6,435,360 B1
(45) Date of Patent: Aug. 20, 2002

(54) VEHICLE SUPPORTED LIFT SYSTEM

(76) Inventor: Steven P. Buchmeier, 935 Elm St., Mauston, WI (US) 53948

( * ) Notice: Subject to any disclaimer, the term of this patent is extended or adjusted under 35 U.S.C. 154(b) by 0 days.

(21) Appl. No.: 09/690,227

(22) Filed: Oct. 17, 2000

Related U.S. Application Data

(63) Continuation-in-part of application No. 09/182,365, filed on Oct. 29, 1998, now abandoned.
(60) Provisional application No. 60/063,888, filed on Oct. 31, 1997.

(51) Int. Cl.[7] ..... B66C 5/00
(52) U.S. Cl. ..... 212/180; 254/100
(58) Field of Search ..... 212/180; 29/256; 254/100

(56) References Cited

U.S. PATENT DOCUMENTS

| | | | | |
|---|---|---|---|---|
| 1,384,169 | A | | 7/1921 | Theberath |
| 1,952,238 | A | | 3/1934 | Dice |
| 1,995,031 | A | | 3/1935 | Lee |
| 2,072,398 | A | | 3/1937 | Faulk |
| 2,224,562 | A | | 12/1940 | Wolf |
| 2,865,585 | A | | 12/1958 | Beyer et al. |
| 3,329,404 | A | | 7/1967 | Castoe |
| 3,652,057 | A | | 3/1972 | Brown |
| 3,731,906 | A | | 5/1973 | Beach |
| 3,837,060 | A | | 9/1974 | Stehling |
| 4,030,705 | A | | 6/1977 | Bontrager |
| 4,043,375 | A | | 8/1977 | Casey |
| 4,183,511 | A | | 1/1980 | Marek |
| 4,469,307 | A | | 9/1984 | Bell |
| 4,774,386 | A | | 9/1988 | Goodwin |
| 5,456,371 | A | | 10/1995 | Klann |
| 5,782,459 | A | * | 7/1998 | Klann ..... 254/323 |

OTHER PUBLICATIONS

Cornwell Tools, *Savings Time* brochure, May, 1996.
Norco Professional Lifting Equipment, Engine Support Tools, p. 29, Catalog No. 7, Oct. 15, 1994.
A & Reds Transmission Parts, *The Ultimate Engine Hanger* leaflet page.
Badger State Equipment & Supply Inc., *Mini Pic* leaflet page.
Drawing from Torrance California Transmissions on engine support.

* cited by examiner

*Primary Examiner*—Thomas J. Brahan
(74) *Attorney, Agent, or Firm*—Boyle Fredrickson Newholm Stein & Gratz S.C.

(57) ABSTRACT

A vehicle supported lift system in which a generally horizontal lift beam is supported at each end by supports. A hand operated lift mechanism is mounted on the beam and operates a vertically movable member extending downwardly from the beam for connection with the vehicle motor. A cast aluminum handle is preferably used to operate the lift mechanism and is manually operated. The hooks are mounted parallel and in close proximity to the horizontal beam and a chain with an attachment means on the end and extend downwardly from the beam. The legs are disposed adjacent the two ends of the beam, and are relatively short to permit the motor lift to be readily and conveniently mounted on the vehicle above the engine or in the cab of van type vehicles.

20 Claims, 10 Drawing Sheets

VEHICLE SUPPORTED LIFT SYSTEM

CROSS-REFERENCE TO RELATED APPLICATION

This application claims benefit of provisional patent application, U.S. Ser. No. 60/063,888 filed Oct. 31, 1997 and is a continuation in part of U.S. Ser. No. 09/182,365 filed Oct. 29, 1998 (now abandoned), the entire contents of which are hereby incorporated by reference.

BACKGROUND OF THE INVENTION

1. Field of the Invention

The present invention pertains to a vehicle supported lift system for installing and removing motor vehicle parts. More specifically the present invention relates to a vehicle supported lift system which is adjustable to fit in the engine compartment of a vehicle. The system has at both ends a telescopic extension section and a main beam in between. Supports are connected by compound swivels to the ends of the extension sections to support the lift system at the edges of an engine compartment of the vehicle body. Lifting hooks and chains are individually displaceable on the main beam because of a hanger having an n-shaped channel.

2. Discussion of Related Art

In servicing and repairing automobile, van, and truck engines, transmissions and other parts, it is often necessary or desirable to lift these vehicle parts a few inches to permit access to the part or location where the work is to be performed. For example, in replacing the motor mounts, the engine must be raised to give sufficient clearance between the bottom of the engine and the vehicle frame to release and replace the worn mounts. Lifting the engine is also necessary in some vehicles in removing the oil pan. In the past, overhead hoists supported by a beam above the vehicle, or a jack placed beneath the vehicle have been used to raise the engine or other part sufficiently to perform the service or repairs. Often times an old 2' by 4' wooden board propped up by shop manuals on the vehicle body is used as a lift. These prior practices have been unsatisfactory, inconvenient and/or hazardous, and in many instances could not be used because of interference encountered from other vehicle parts such as the hood, cab or frame members.

The below-referenced U.S. patents disclose embodiments that were at least in-part satisfactory for the purposes for which they were intended. The disclosures of all the below-referenced prior United States patents, and applications, in their entireties are hereby expressly incorporated by reference into the present application for purposes including, but not limited to, indicating the background of the present invention and illustrating the state of the art.

U.S. Pat. No. 5,456,371 to Klann shows a vehicle-mounted lifting bridge with telescopic support beams which are mounted to A-frame like feet that are pivotally mounted to the support beam. Klann does not disclose a hood support or generally n-shaped hangers mounted on the support beam for supporting an engine. Nor does Klann disclose a rounded, polymer coated support stand connected to the beam by a compound swivel.

U.S. Pat. No. 4,774,386 to Goodwin shows a cross beam and various attachments for supporting a vehicle motor. Goodwin does not disclose a hood support, a compound swivel for pivoting, a rounded, polymer coated support stand to the cross beam, or mounting n-shaped hangers on the cross beam.

Therefore, it would be desirable to have a vehicle supported lift system that solves the aforementioned problems.

SUMMARY AND OBJECTS OF THE INVENTION

The present invention provides a vehicle supported lift system that overcomes the aforementioned problems, and can be adjusted to fit into the engine compartment of any vehicle, even today's aerodynamically-shaped vehicles.

In accordance with one aspect of the invention, the vehicle supported lift system provides a lift device for raising vehicle parts a few inches to permit service and repair operations to be conveniently performed, which does not depend upon nor require a support external of the vehicle.

In accordance with another aspect of the invention, the vehicle supported lift system provides a vehicle engine motor lift which can readily be adjusted to handle engines, transmissions, or other parts located under the hood in automobiles or those in or under the cab of trucks and vans, and which is easily mounted and operated on or in the vehicle in position where the engine, transmission, or other part can be most effectively lifted to provide the desired working clearance for the service or repair work being performed.

Yet another object of the present invention is to provide a vehicle supported lift system with greater stability, strength, durability and versatility than prior art lift systems in order to better fit today's world-wide market of automobiles.

Another object of the invention is to provide a vehicle supported lift system that is covered with a protective coating so that it will not slip, and it does not scratch the finish of the vehicle.

A further object is to provide a vehicle motor lift device of the aforesaid type which is convenient and safe to use, and which is simple in construction and operation and can be easily stored when not in use, and readily carried or otherwise moved into operating position on the vehicle on which the service or repairs are to be made.

These, and other, aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which.

Figure 1:
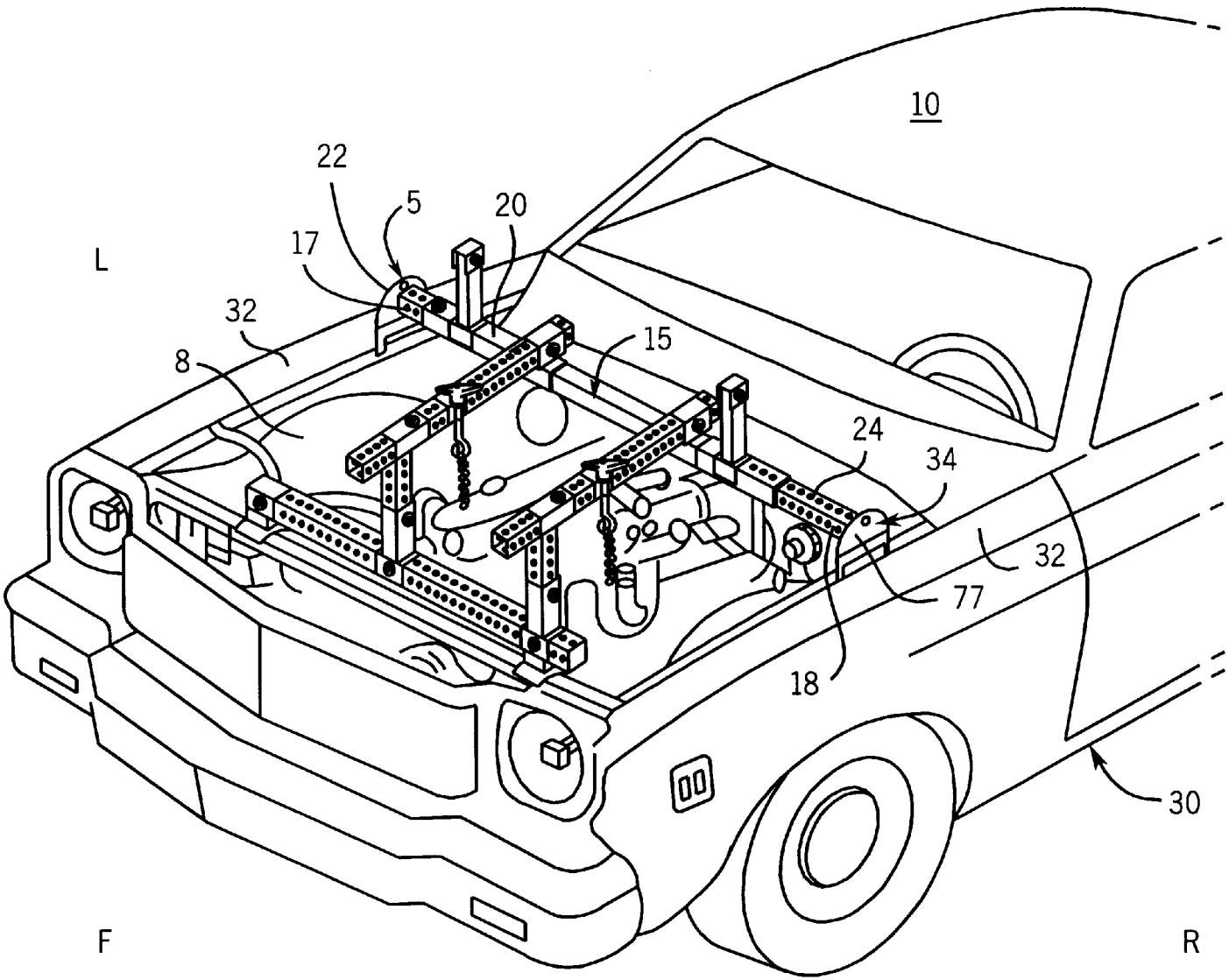
FIG. 1 is an isometric view of the lift system of a first embodiment of the present invention supported by vehicle in the engine compartment.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DETAILED DESCRIPTION OF THE PREFERRED EMBODIMENT

The present invention and the various features and advantageous details thereof are explained more fully with reference to the non-limiting embodiments described in detail in the following description.

FIG. 1 shows a first embodiment of a vehicle supported lift system 5 according to the present invention. The present invention is a lift system 5 which can be placed in the engine compartment 8 of nearly any vehicle 10 to aid a mechanic in lifting various parts out of the vehicle 10. The system 5 can also be used to hold parts which need to be moved by the mechanic while the mechanic gains access to other areas within the engine compartment 8. For example, the lift system 5 is useful when working on motor mounts, transmissions, clutches, and oil pans.

The vehicle supported lift system 5 includes a generally horizontal lift beam 15 which in the preferred embodiment includes three components: a main beam 20, a left extension section 22, and a right extension section 24. The extension section 22, 24 allow the system 5 to adjust to fit nearly any size vehicle. The lift beam 15 has a left (L) end 17 and a right (R) end 18 as it is viewed from the front (F) of the vehicle 10.

Figure 2:
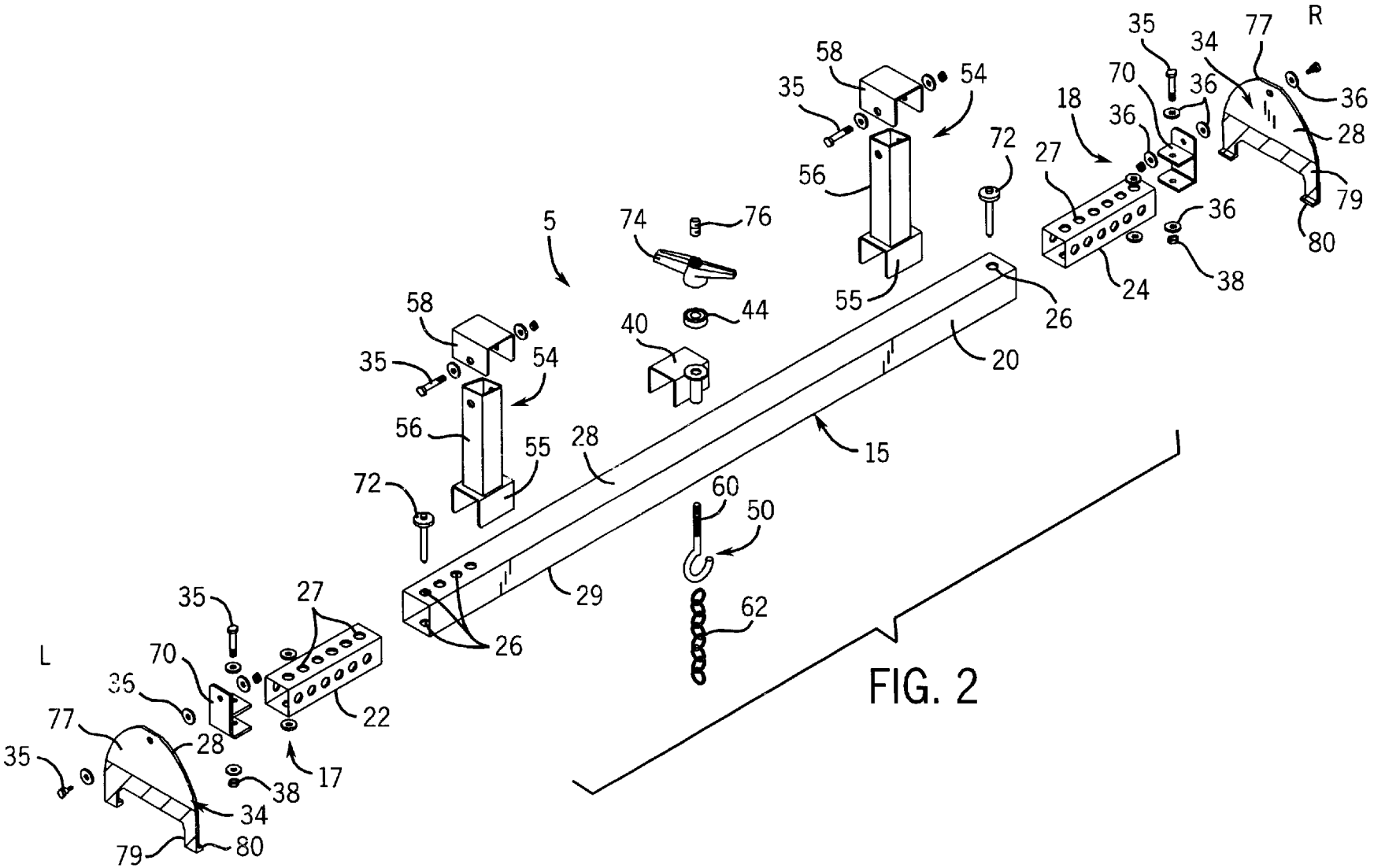
FIG. 2 is an exploded isometric view of one embodiment of lift system of the present invention of FIG. 1.

As shown in FIG. 2, the main beam 20 has a top 28, a bottom 29 opposite the top, at least five holes 26 in the top 28 which are aligned with one hole 26 each in the bottom The holes 26 are arranged to allow extension section 22 to adjust in ¼ inch increments during use. The main beam 20 has a left end and right end that are relative to the left end 17 and right end 18 of the lift beam 15. The right end 18 is adjacent to the top 28, as is the right end 18 which is opposite the left end 17.

The main beam 20 and the extension sections 22, 24 are made of square tubular steel, although many other geometries and materials are just as feasible. In the preferred embodiment, the diameter of the main beam 20 is slightly larger than the diameter of the extension sections 22, 24 so that the extension sections 22, 24 can be slidably received in the main beam 20 with a relatively tight fit. Of course, the main beam 20 diameter may be slightly smaller than that of the extension sections 22, 24 so that the main beam 20 may be received by both sections 22, 24.

The main beam 20 and the extension sections 22, 24 have a plurality of holes 26 drilled through them. These holes 26 allow the lift beam 15 to be extended in increments between 1 inch and ¼ of inch. In the preferred embodiment, the right end 18 of the lift beam 15 can be extended in increments of ¼ inches or more if desired. The lift beam 15 may be adjusted in length by moving the left section 22 or right section 24 as desired between about 49 inches and 73 inches.

Prior art lift systems generally cannot be adjusted from either side of the vehicle This causes problems because the mechanic must then waste valuable time walking around the vehicle, often several times, in order to properly adjust the lift system. With the lift system 5 of present invention, there is no need to for the mechanic leave the side of the vehicle on which the mechanic is standing to make the necessary adjustments. After adjustments are made, the lift system 5 then properly fits into the engine compartment 8. Further, most prior art systems cannot be adjusted in such fine increments. Thus, these systems often do not fit into the engine compartment very well. The ability to more accurately adjust the inventive lift system gives it an advantage over the prior art.

A quick release pin 72 is received in the holes 26 in the main beam 20 and are also received in the holes 27 for the extension sections 22, 24 and pass out the opposite side they entered locking the section into place along the main beam 20. The quick release pin 72 can be easily released when one desires to adjust the lift beam 15 or when the lift beam is collapsed for ease of storage. The quick release pins 72 offer the mechanic an advantage over most conventional systems. For example, such conventional systems often require wrenches to make an adjustment and offer no way at all to lock main beam 20. Therefore, the quick release pins 72 generally save the mechanic valuable time, and offer more safety and security.

In the preferred embodiment, a pair of beam supports 34 are connected to the lift beam extension sections 22, 24 located at the left end 17 and the right end 18 of the lift beam 15. In one preferred embodiment, the beam supports 34 are first connected to a compound swivel 70 before they connect to the respective right and left extension sections 21,22.

Figure 3:
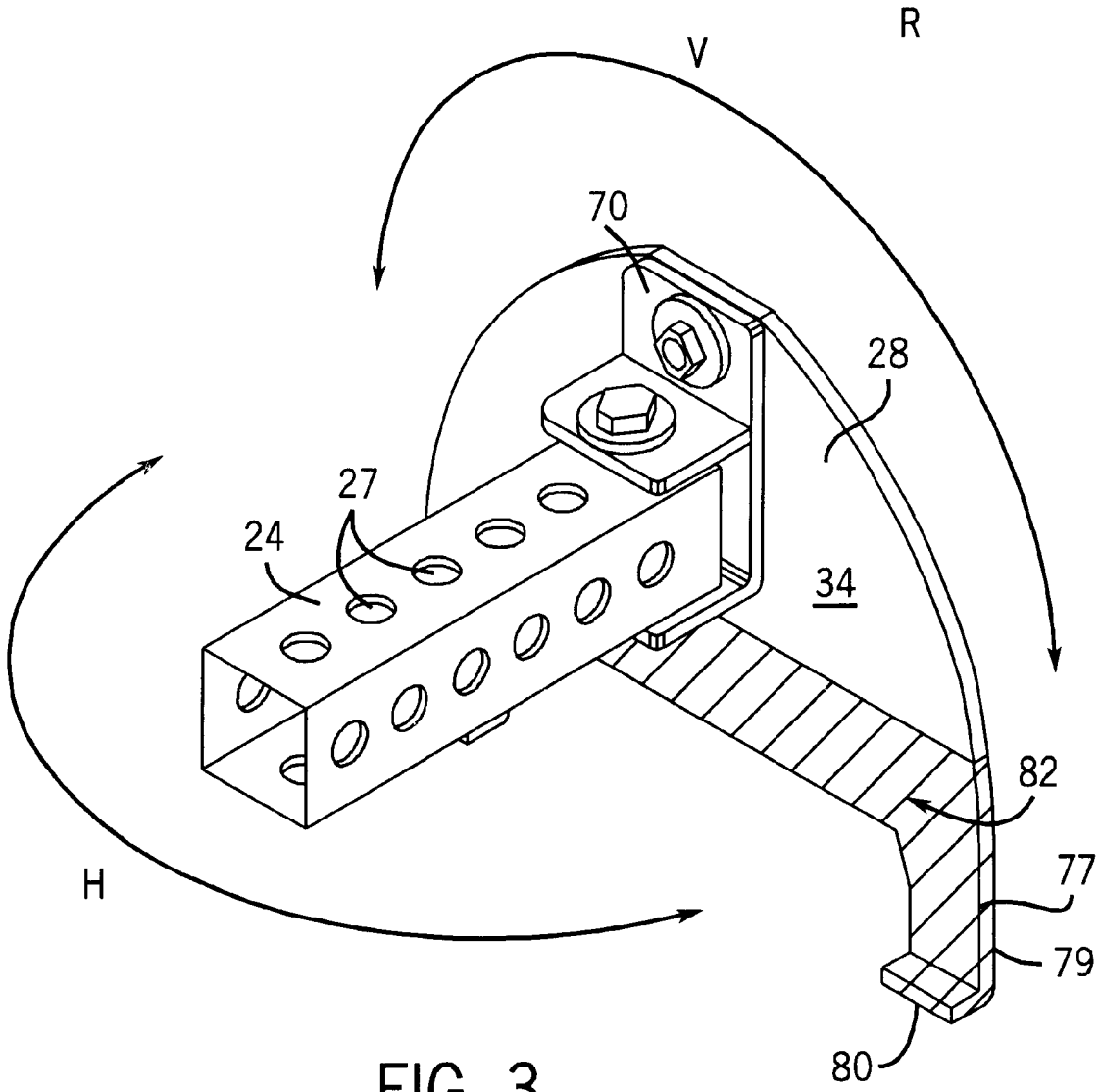
FIG. 3 shows a magnified isometric view of the end portion of the lift system of FIG. 1.

The compound swivel 70 pivotally rotatably connects the beam supports 34 to the left end 17 and the right end 18 of the beam 15, as best shown in FIG. 2. The singular, compound swivel 70 allows a sole technician to move the supports horizontally (H) and vertically (V) as illustrated in FIG. 3. This is an important feature of the compound swivel 70 because there is a move in the automobile market toward more rounded, aerodynamic vehicle body shapes, such as those present on today's mini-vans. With the aid of the compound swivel 70, the lift system 5 of the present invention can be adjusted to fit nearly any vehicle body shape or design without sacrificing safety and stability.

The beam supports 34 in one preferred embodiment are stands 77 which may have two legs 79 and two feet 80 each to ensure ease of placement on the vehicle fender 32 and to maximize stability of the lift system 5, as best shown in FIG. 1. The individual feet further provide a hook or engaging point for the stand to latch to bolts connected to the vehicle's fender. This feature is important when the vehicle being worked on has a sloping hood. As best shown in FIG. 2, these supports 34, or stands 77 in this case, are preferably formed or cut from a single plate of material, such as sheet steel and have a generally rounded upper portion 78 for added strength over the triangular shaped stands in the prior art. This can be important when the stand is performing heavy lifting. The legs 79 and feet 80 are integral with the generally rounded upper portion 78. Both the legs 79 and feet 80 are coated with a protective polymer 82.

The protective polymer coating 82 provides a non-slip surface for the feet 80 and legs 79 of the lift system 5. Also, the protective polymer coating 82 helps to prevent the feet 80 and legs 79 of the stand 77 from scratching the vehicle 10, especially the finished surfaces of the vehicle. As best shown in FIG. 2 by the cross-hatching, the protective coating 82 may extend beyond merely the feet and the legs toward the upper generally rounded portion for added protection. The protective polymer 82 may be actually applied to the stand 77 by dipping the stand in the polymer. This dipping process better bonds the polymer coating to the stand and enhances the durability of the polymer coating.

Figure 6:
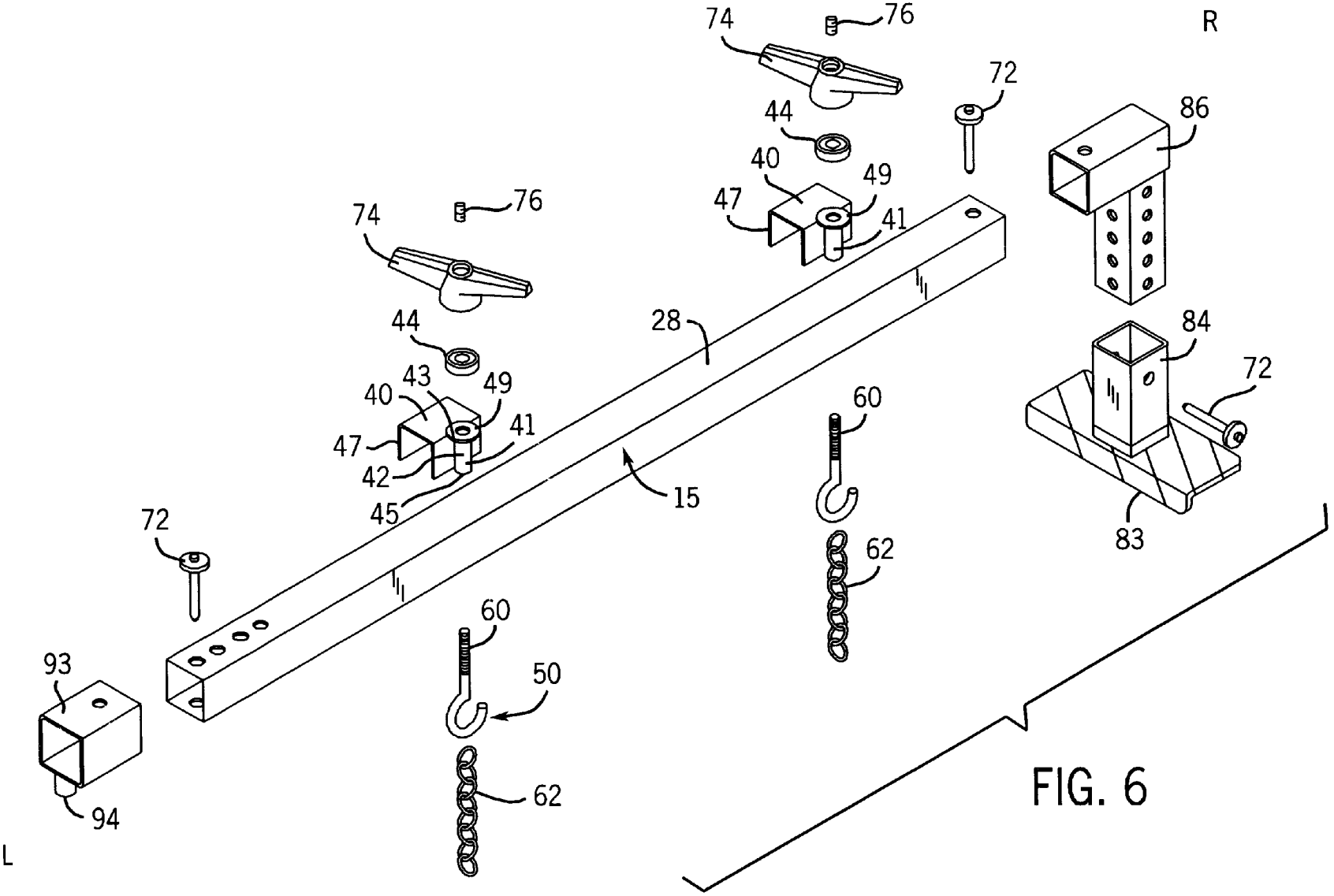
FIG. 6 is an exploded isometric view of yet another embodiment of the invention shown in FIG. 1.
Figure 7:
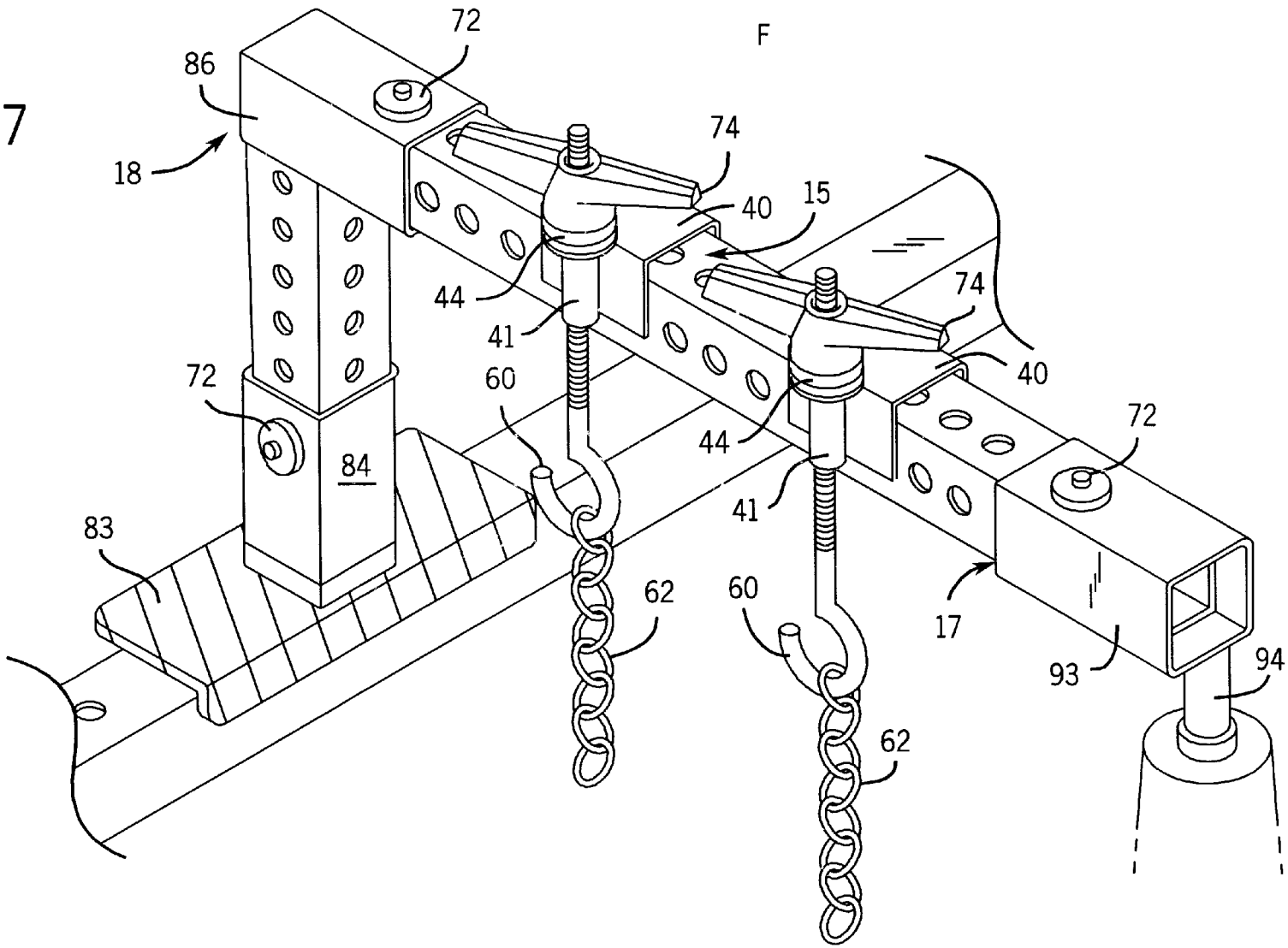
FIG. 7 is an isometric view of the embodiment of the invention shown in FIG. 6.

In another embodiment, shown in FIGS. 6 and 7, the beam supports are steel members 83, 84, 86, 93, and 94. This embodiment is particularly advantageous for use with, for example, Chevrolet® Lumina® or APV® mini-vans. The generally aerodynamic body and fender shape of these vehicles makes it difficult to use the stand beam supports. Therefore, this embodiment may rest on the left end 17 on a bolt that protrudes from a vehicle's shock tower and on the right end 18 on a core support arm that extends from a fender to a radiator, as best shown in FIG. 7. At the left end 17 resting on the shock tower, the beam support may include an adapter sleeve 93 and a mounting toe 94. The adapter sleeve 93 is slidably received by the beam 15 and may be locked into place when properly adjusted by a quick release pin 72 that is inserted through hole in the sleeve 93 and holes in the lift beam 15. The sleeve 93 may be made of square tubular steel having a diameter slightly larger than the lift beam 15. The toe 94 is constructed and arranged so that it fits over the bolt which protrudes upwardly from the ground through the top of the shock tower. The toe 94 is preferably made of a round metal tube and is sufficiently long to properly stabilize the lift beam 15 on top of the shock tower.

On the opposite end of the lift beam 15 (in this embodiment, the right end 18), the beam support includes a safety coupler 86, an adapter leg 84, and an adapter foot 83. The adapter leg 84 is made of square tubular steel. The adapter foot 83 is made from plate or sheet steel and is bent down slightly to better fit over the core support arm. As shown generally in the drawing, the sleeve 93 and mounting toe 94 and the adapter leg 84, the foot 83 and coupler 86 are interchangeable depending on the desired application of the lift system. Additionally, a standard stand 77 may be attached to the lift beam in lieu of either the toe 94 or leg 84 and foot 83.

As best shown in FIG. 6, in the preferred embodiment, at least one hanger 40, is slidably received by the lift beam 15. [The hanger 40 includes a tube 41 having a side wall 42 (hereafter wall 42), a top portion 43 (hereinafter top 43) above the wall 42, and a bottom portion 45 (hereinafter bottom 45) below the wall 42, and a generally n-shaped channel 47.] The hanger channel 47 is preferably formed from a single piece of sheet metal bent generally into the shape of an "n". The tube 41 is attached to the channel preferably by welding. The tube is made of metal or a material of sufficient strength and rigidity. A washer 49 is attached, again preferably by welding, to the top of the tube.

The n-shape of the channel 47 provides a versatility that allows for controlled and balanced support of the lift system members, such as the hanger 40. The n-shape also allows ease of movement and very quick disassembly which is extremely important in a mechanics' garage where time and effort add up to additional dollars needed to do a job.

An adjustable lifting device 50, for example a hook 60, is attached to the hanger 40. The hook 60 is preferably inserted into the hole in the tube and the washer, as shown in FIG. 7. A bearing 44 preferably sits on top of the washer 49 and also receives the hook 60 through a hole. A handle 74 attaches to the lifting device 50 or hook 60. The handle may be made from cast aluminum to improve its durability and resistance to dust and corrosion in the garage environment. The hook 60 is generally threaded to receive the cast aluminum handle. The handle 74 may have a threaded steel insert 76 to receive the threads of the lifting device 50. The insert 76 is made of steel to prevent the wear and stripping of the threads. Multiple hangers 40 and lifting devices 50 are desirable for many applications.

Figure 4:
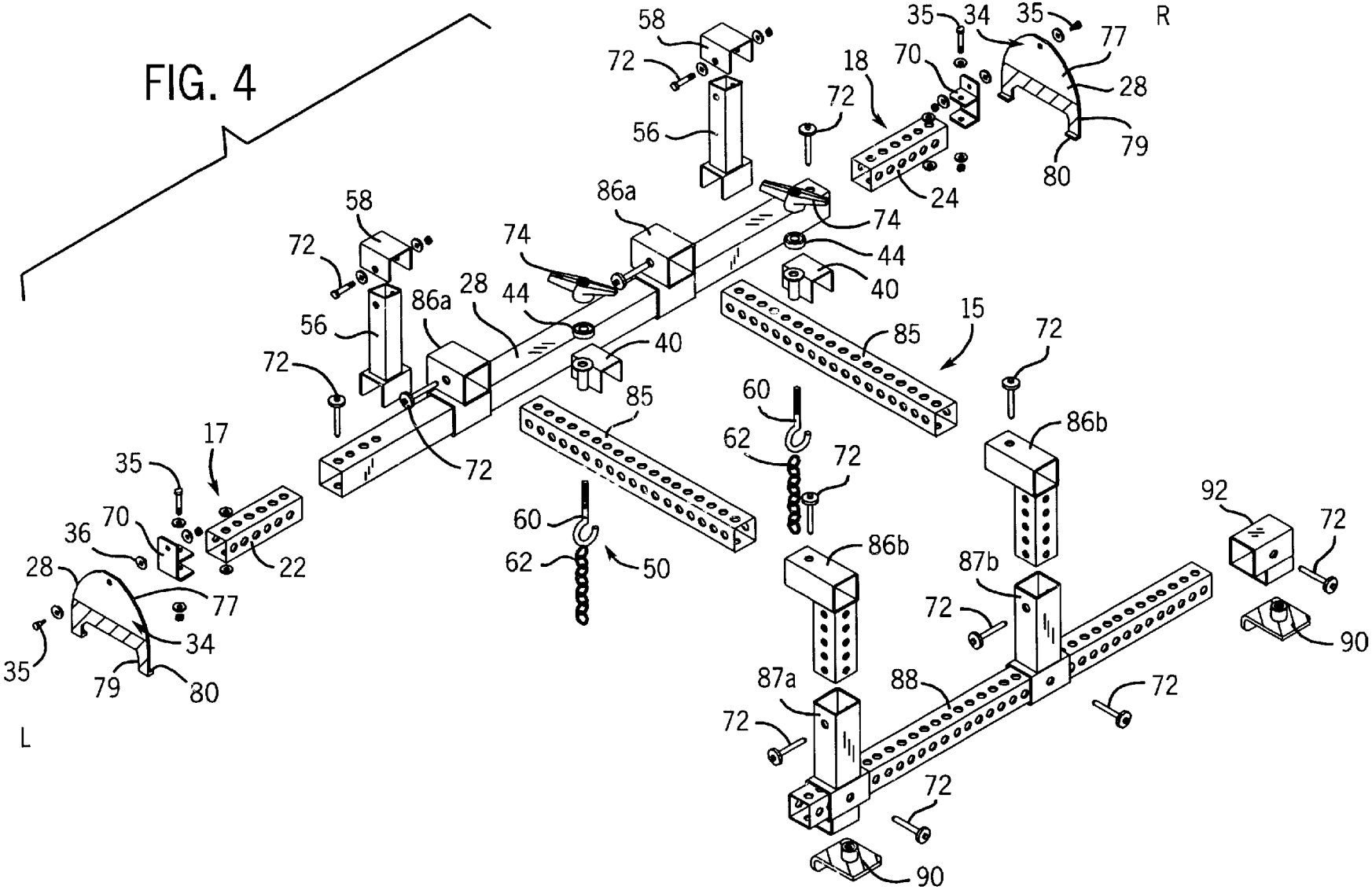
FIG. 4 is an exploded isometric view of another embodiment of the invention of FIG. 1.
Figure 5:
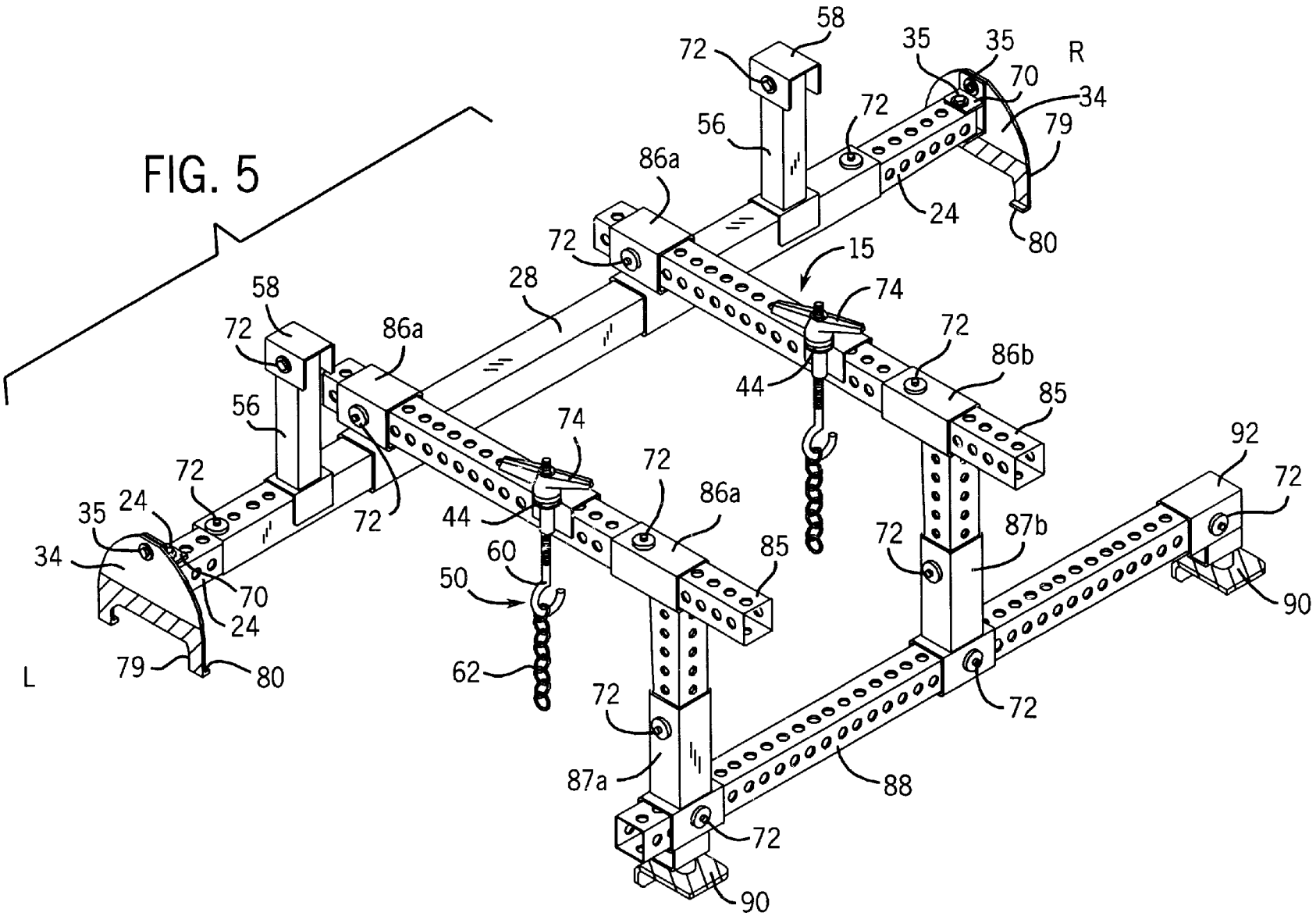
FIG. 5 is an isometric view of the embodiment of the invention shown in FIG. 1.

The lift system 5 may further comprise an auxiliary beam 85 adjustably connected to the lift beam 15, as shown in FIG. 4. As shown in FIGS. 4 and 5, the use of multiple auxiliary beams 85 connected to the lift beam 15 is desirable. The use of an auxiliary beam 85 allows added stability because the beam rests on the structural elements of the front end of the vehicle 10. The auxiliary beam 85 also allows the lift system 5 to extend its reach toward the front (F) end of the vehicle 10. For example, additional hangers 40 may be hung from the auxiliary beam 85 to provide more lifting options to the mechanic if needed. Again, with so many different makes and models of vehicles in the market this added feature expands the usefulness and capabilities of the lift system of the present invention.

A safety coupler 86*a* connects the auxiliary beam 85 to the main beam 20. The safety coupler may be attached to the auxiliary beam by at least one quick release pin 72 received by the holes in the sides of the coupler 86*a* and the side holes in the auxiliary beam. Thus, the quick release pin 72 acts to lock the auxiliary beam into place. A tubular section of the safety coupler 86*a* fits around the main beam 20 and allows for slidable adjustment of the safety coupler and auxiliary beam 85 along the main beam 20.

An auxiliary support post 87*b* is connected to the auxiliary beam 85 by a coupler post 86*b* and an auxiliary support leg 88 is in turn connected to the auxiliary support post 87*b*. The auxiliary support post 87*b* rests on the leg 88. A post with foot 87*a* may also be used. The auxiliary support leg 88 rests on a adjustable, swiveling support foot 90 slidably connected to the auxiliary support leg 88. The foot 90 may be connected to the post or independently connected to the leg 88. The swiveling support foot 90 may be coated with a protective polymer coating 82 to protect the vehicle 10, as shown in FIG. 5 by the cross-hatching.

The system 5 may further comprise a hood support 54 slidably connected to the beam 15 which supports the vehicle hood (not shown) and prevents the hood from crashing down on the mechanic working in the engine compartment 8. As shown in FIGS. 4 and 5, the hood support 54 includes a generally n-shaped channel 55, a hood support brace 56, and a hand 58. The channel 55 is formed from a single sheet of metal and bent in two places to generally form an "n". The channel 55 is connected by preferably welding to the support brace 56. The support hand 58 is pivotally connected to the brace 56 so that it is capable of pivoting to follow the contour and upward angle of the hood. In this case, a bolt 35 and nut 38 fit through holes in the hand 58 and brace 56 to form a hinge on which the hand 58 may pivot.

A chain 62 or strap may also be attached to the lifting device 50 for ease of use. For example, the chain or strap can be used by the mechanic or technician to secure a part while work is performed.

Figure 8:
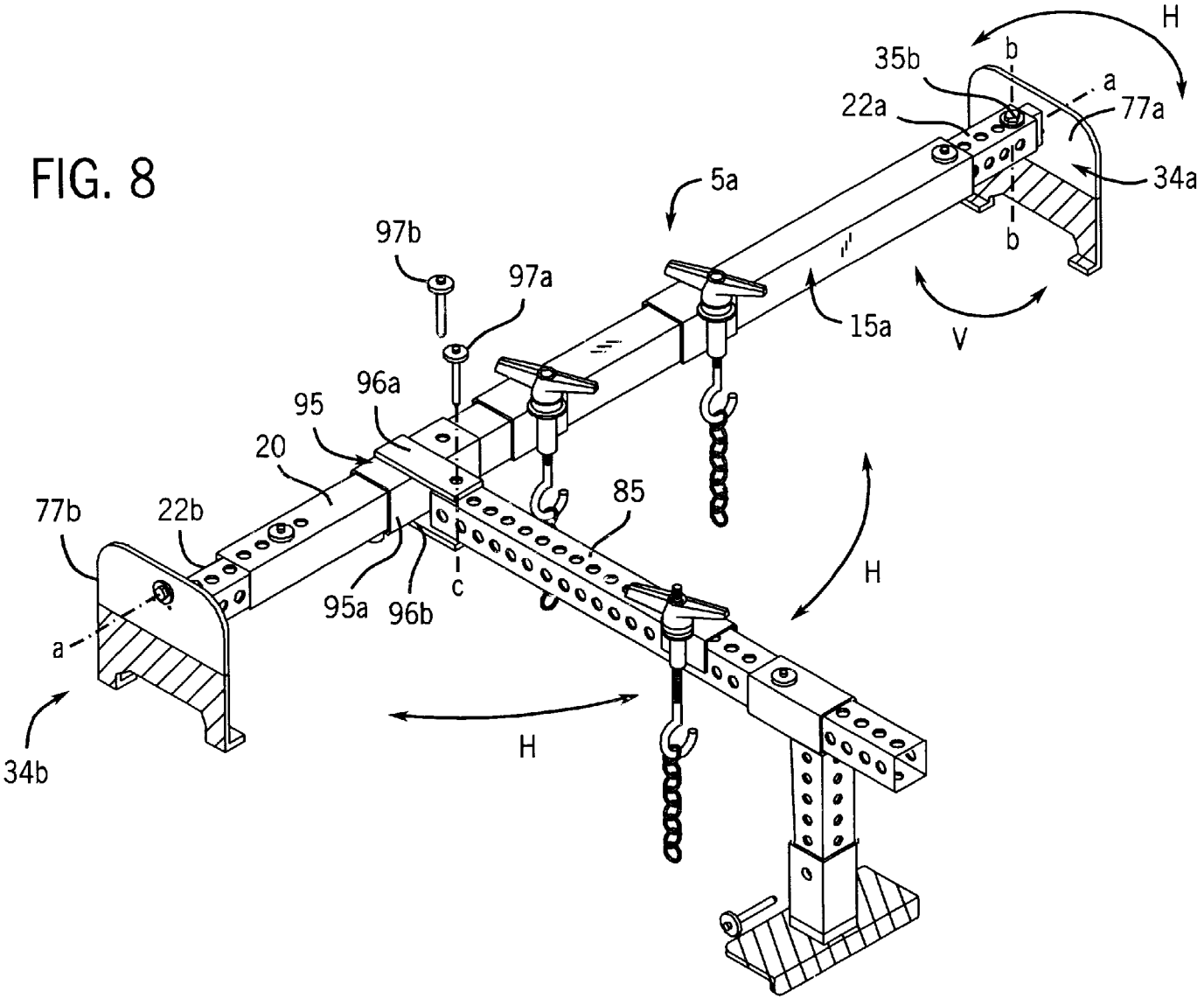
FIG. 8 is an isometric view of yet another second embodiment of the invention.
Figure 8A:
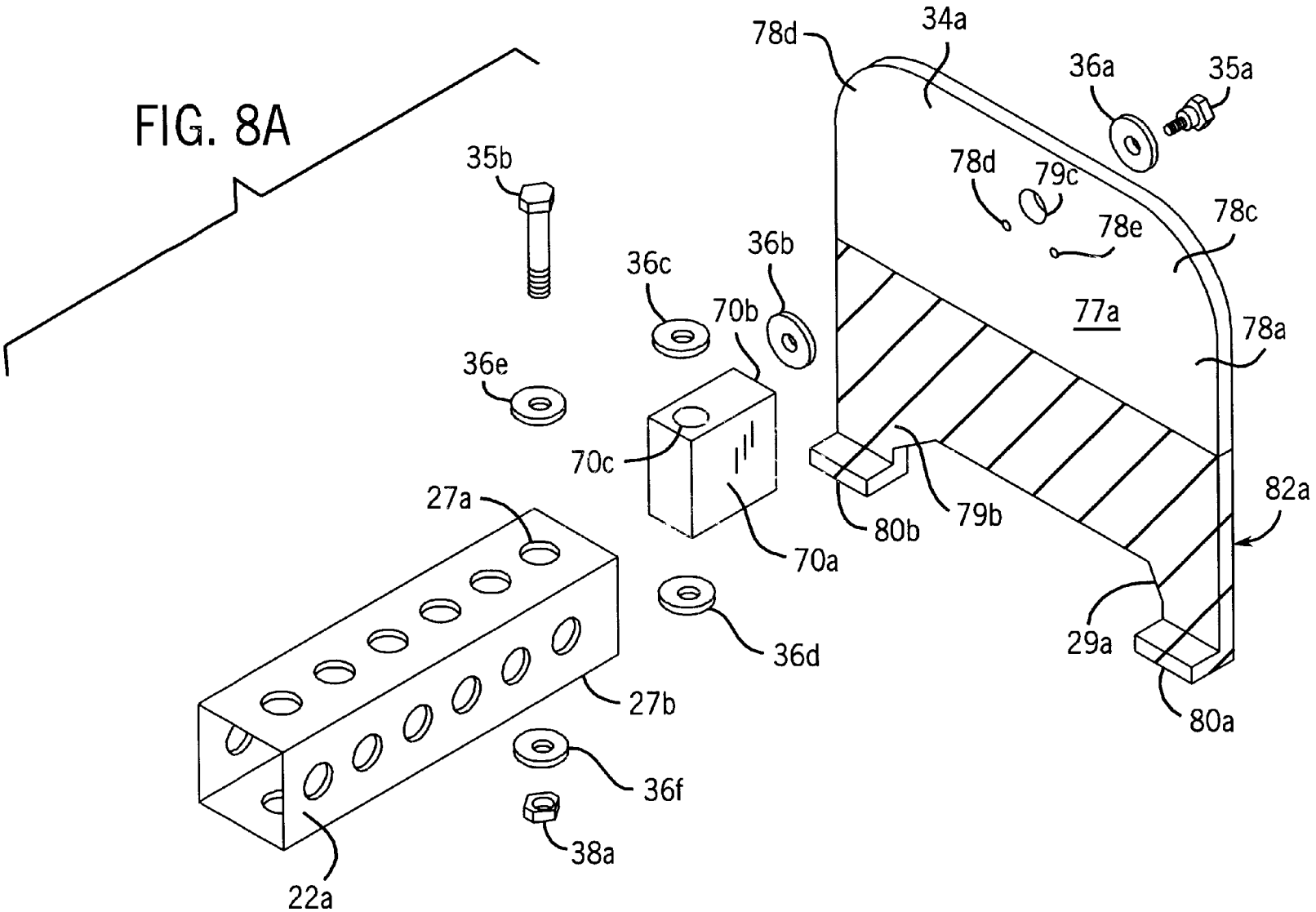
FIG. 8*a* is an exploded isometric view of one portion of the invention including the compound swivel shown in FIG. 8.

In another embodiment, best shown in FIGS. 8 and 8A, beam supports 34*a,* 34*b* take the form of stands 77*a,* 77*b.* As best shown in FIG. 8A, the stands 77*a,* 77*b* have two legs 79*a,* 79*b* and two feet 80*a,* 80*b* . The legs 79*a* 79*b* in this embodiment are shorter than those shown in FIG. 3. This modification lowers the center of gravity of the stands 77*a* and 77*b.* These stands 77*a,* 77*b* are also preferably sheet steel (3/16 of an inch thick) and have a generally rounded corners 78*c* and 78*d* on upper portion 78*a.* This shape is different from that of the stand shown in FIG. 3 in that it has added material for added mass and additional added strength. These features are particularly important when the stand is configured to upwardly lift particularly heavy loads. As in the preferred embodiment, the legs 79*a,* 79*b* and feet 80*a,* 80*b* are preferably integral with the upper portion 78*a* and are coated with a protective coating 82*a.*

Also shown in FIG. 8A is an alternative compound swivel 70*a.* Like the compound swivel 70 of FIG. 3, the compound swivel 70*a* is singular multi-directional joint. As such, the compound swivel 70*a* allows the stands 77*a,* 77*b* to move horizontally (H) and vertically (V). This is particularly important when working on aerodynamic vehicles, such as mini-vans, which have downwardly sloping hoods that hinder stabilization of conventional lift systems. In use, the compound swivel 70*b* allows a lone operator to adjust the center of gravity by slightly vertically rotating the main beam or main beam extension 22*a,* 22*b* along the stands 77*a,* 77*b* around the axis "A" created by attaching bolt 35*a* as best shown in FIG. 8.

In one preferred embodiment shown in FIG. 8A, raised nipples 78*d,* 78*e,* which are punched or welded to the stand 77*a,* act as safety stops and prevent the beam 22*a* from rotating 360°.

The compound swivel 70*a* in this embodiment is a block of steel or aluminum which is dimensioned to fit inside extension beam 22*a,* 22*b* and still be capable of substantial horizontal movement when bolted into place. The block 70*a* includes a side hole 70*b* which enters one side of the block and stops within. The side hole 70*b* is preferably threaded for receiving a bolt 35*a.* Preferably, the block has a top hole 70*c* which enters the top of the block and exists out the bottom. A bolt 35*b* extends through a washer 36*e,* a hole 27*a* of beam extension 22*a,* and a shim washer 36*c,* top hole 70*c* of block 70*a,* a shim washer 36*d,* a hole 27*b* on the bottom of the beam 22*a,* through a washer 36*f,* and is secured by nut 38*a.* This arrangement allows the stand to horizontally rotate around axis b created by bolt 35*b* as best shown in FIG. 8.

Preferably, the bolt 35*a* is a special bolt in that it has an enlarged (e.g. 7/16 diameter) head shaft portion which has a greater diameter than that of the main shaft diameter. In the embodiment shown in FIG. 8A, a washer 36*a* having a 7/16 diameter hole fits around the head shaft portion of 35*a.* The bolt 35*a* then passes through hole 78*a* in the stand 77*a* and then through a washer 36*b* before entering a tapped side hole 70*b* in the block 70*a* to be secured. The block design is well-suited for heavier applications, and the swivel 70 and is somewhat more economical and relatively easier to manufacture than the corresponding structure of the first embodiment. No other conventional lift has a singular joint member which allows rotation in both a horizontal and a vertical direction.

FIG. 8 also shows an alternate coupler embodiment for the auxiliary beam 85. Coupler 95 includes a sleeve 95*a* having two transversely protruding connecting plates 96*a,* 96*b.* A first quick release pin 97*a* penetrates through a first hole in the first plate 96*a* and then enters a hole in top the auxiliary beam 85. The first pin 97*a* exits out another hole on the bottom of the beam 85 and goes through a hole in plate 96*b.* A second pin 97*b* secures the coupler 95 in place along main beam 20 by penetrating holes in the coupler sleeve 95*a* and in the main beam 20. This configuration gives the beam 85 the ability to horizontally swing around the axis c created by first pin 97*a.* This swivel capability is particularly useful for certain applications such as the Northstar® engine used in Cadillacs®.

Figure 9:
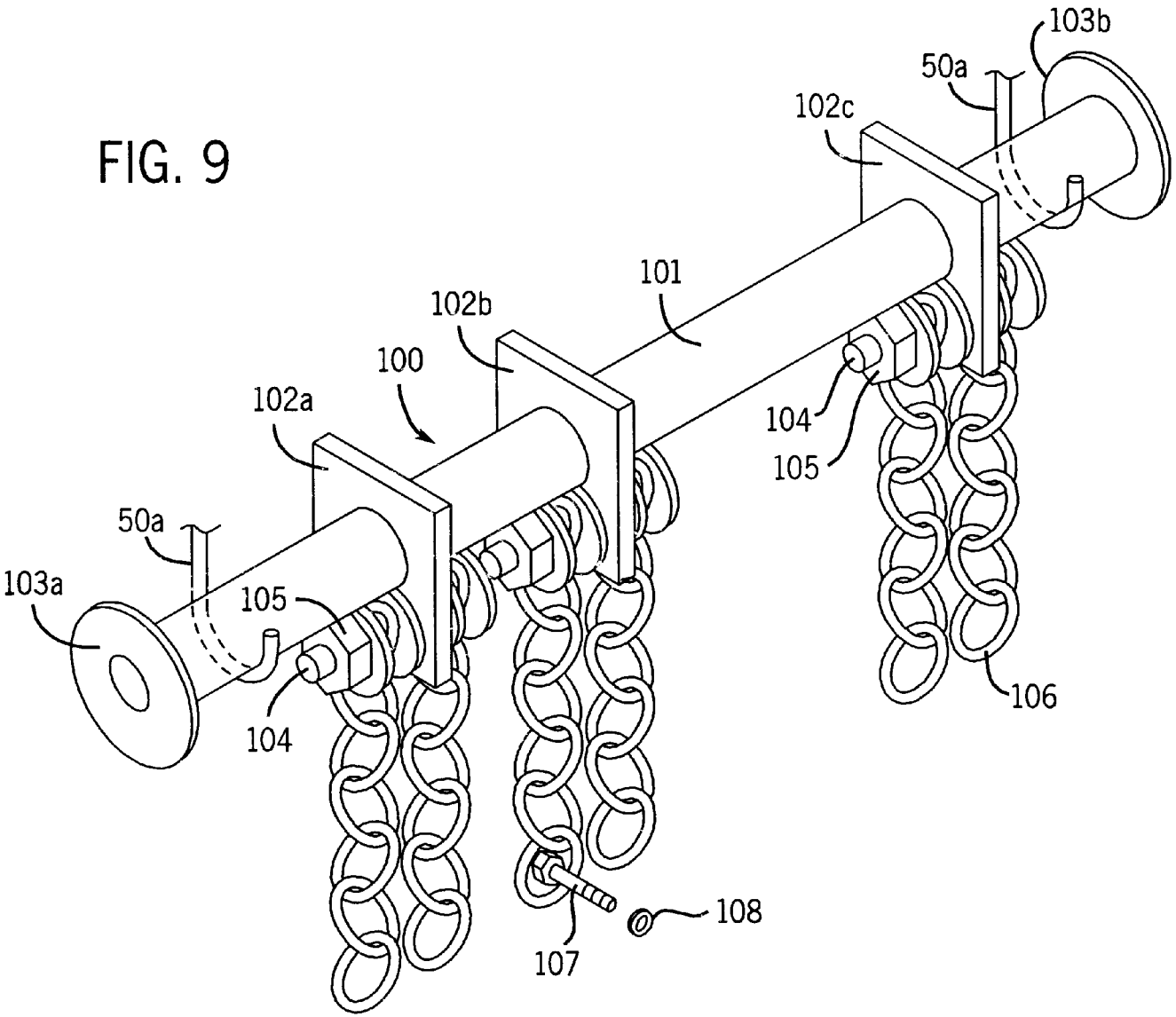
FIG. 9 is an isometric view of still another embodiment of the invention including an adaptor bar.

FIG. 9 shows a lift attachment adapter bar member 100 that is particularly useful for vehicles which have plastic capped engines such as the 1996--1998 Ford® Windstar® and Mercury® Villager® 3.8 liter engines. Preferably, the member 100 includes a tubular portion 101 and a plurality of engine holders 102*a,* 102*b,* 102*c.* The engine holders 102*a,* 102*b,* 102*c* have chains 106 attached thereto, by preferably grade A bolts 104 secured by nuts 105. Disks 103*a* and 103*b* are attached at the outermost ends of the tubular potion 101. The chains 106 are attached to the plastic engine caps (not shown) by bolts 107 threaded through washers 108. The washers 108 are large enough so they will not pass through the hole in the chain 106 during the lifting operation. The member 100 is operably attached to the lift system 5 (NOT SHOWN) by j-hooks 50*a,* 50*b.*

The lift system 5 of the present invention is designed to be universal in application so that is can fit nearly any make or model of automobile, pickup truck or van. This is very economical as a repair shop need only buy one tool instead of several different specialized tools.

After the transmission or other part has been safely removed or replaced using the lift system 5, the lift system 5 can be easily lifted from the vehicle 10 and disassembled and/or broken down by a sole technician. In its compact, broken down or disassembled state, the lift system 5 can be stored without occupying any substantial usable space in a garage or service station. Its lightweight construction makes it readily transported in a vehicle from one location to another.

Although the best mode contemplated by the inventors of carrying out the present invention is disclosed above, practice of the present invention is not limited thereto. It will be manifest that various additions, modifications and rearrangements of the features of the present invention may be made without deviating from the spirit and scope of the underlying inventive concept.

For example, the individual components need not be fabricated from the disclosed materials, but could be fabricated from virtually any suitable materials. Moreover, the individual components need not be formed in the disclosed shapes, or assembled in the disclosed configuration, but could be provided in virtually any shape, and assembled in virtually any configuration. Further, although the lift system parts described herein may be shown as physically separate modules, it will be manifest that some may be physically integrated. Furthermore, all the disclosed features of each disclosed embodiment can be combined with, or substituted for, the disclosed features of every other disclosed embodiment except where such features are mutually exclusive.

It is intended that the appended claims cover all such additions, modifications and rearrangements. Expedient embodiments of the present invention are differentiated by the appended subclaims.

I claim:

1. A vehicle supported lift system comprising:

a lift beam having a first end and a second end;

a pair of beam supports each connected to at least one of the first end and the second end of the lift beam for supporting the lift beam;

a hanger engaging the lift beam, the hanger including a tube having a side wall portion, a top portion above the side wall portion, and a bottom portion below the side wall portion, a channel formed from a single piece of metal, the channel being generally n-shaped as to be engageable on the lifting beam by vertically sliding the channel onto the beam, the channel being attached to the side wall portion of the tube, and a washer attached to the top portion of the tube;

an adjustable lifting device attached to the hanger; and a hood support slidably connected to the beam, the hood support including a channel slidably connected to the beam, a brace connected to the channel, and a hand pivotally connected to the brace.

2. The lift system of claim 1, further comprising a chain attached to the lifting device; and an adapter bar member attached to the lifting device.

3. The lift system of claim 1, further comprising a compound swivel connection pivotable to at least one of the left end and the right end of the lift beam for laterally and transversely connecting the beam supports to the lift beam.

4. The lift system of claim 1, wherein the lift beam comprises:

a main beam having a top, a bottom opposite the top, a hole in the top, a hole in the bottom aligned with the hole in the top, a left end adjacent to the top, and a right end opposite the left end; and a pair of extension sections slidably received on the left end and right end of the main beam, wherein each section has a plurality of holes.

5. The lift system of claim 4, wherein at least one extension section has a plurality of holes therein to allow adjustments to the length of the lift beam in increments of about ¼ inches.

6. The lift system of claim 5, further comprising at least two quick release pins received by the holes in the top and bottom of the main beam and by the holes in the extension sections for locking each of the extension sections into place.

7. The lift system of claim 1, wherein each beam support has a leg and a pair of feet connected to the leg, each foot being coated with a protective polymer.

8. The lift system of claim 1, wherein the lift beam can be adjusted in length between about 47 inches and 73 inches by a sole technician working on a mini-van.

9. The lift system of claim 1, wherein the lifting device is a hook.

10. The lift system of claim 9, further comprising an adapter bar member, connected to at least one hook and including a tubular portion, and a plurality of engine holders attached to the tubular portion.

11. The lift system of claim 1, wherein at least one beam support has a generally rounded upper portion.

12. The lift system of claim 1, wherein at least one beam support is an adaptor leg.

13. The lift system of claim 1

(1) wherein each beam support has (a) a generally rounded upper portion, (b) a lower portion including a leg, and (c) a foot connected to the leg, all formed from a single piece of material and (2) wherein the leg and the foot help prevent the lift system from slipping.

14. The lift system of claim 13, further comprising:

an auxiliary beam;

a safety coupler configured to connect the auxiliary beam to the lift beam;

an auxiliary support post connected to the auxiliary beam;

an auxiliary support leg connected to the auxiliary support post; and an adjustable support foot slidably connected to the auxiliary support leg;

wherein the swiveling support foot moves independently of the auxiliary support post and leg.

15. The lift system of claim 14, further comprising:

a coupler including a sleeve having two transversely protruding connecting plates;

an auxiliary beam swingably connected to the lift beam by the coupler; and a compound swivel connection pivotable to at least one of the left end and the right end of the lift beam for laterally and transversely connecting the beam supports to the lift beam.

16. The lift system of claim 1, further comprising a chain attached to the lifting device;

an adapter bar member attached to the lifting device; and a compound swivel connection pivotable to at least one of the left end and the right end of the beam for laterally and transversely connecting the beam supports to the beam.

17. The lift system of claim 1, wherein the lift beam may be adjusted in length by a sole technician working on a minivan; and the lifting device is a hook.

18. The lift system of claim 1, further comprising a chain attached to the lifting device;

an adapter bar member including a tubular portion attached to the lifting device;

a singular, compound swivel connection pivotable to at least one of the left end and the right end of the beam for laterally and transversely connecting the beam supports to the beam; and a plurality of engine holders attached to the tubular portion.

19. The lift system of claim 1, further comprising a coupler for an auxiliary beam, the coupler including, a) a sleeve having two transversely protruding connecting plates;

b) a first quick release pin penetrating through a first hole in a first plate, entering a hole in an auxiliary beam, exiting a hole in the bottom of a beam and moving through a hole in the plate; and c) a second pin penetrating the holes in a coupler sleeve to secure the coupler in place along the lift beam.

20. The lift system of claim 1, further comprising a compound swivel connection pivotable to at least one of the left end and the right end of the beam for laterally and transversely connecting the beam supports to the beam, the compound swivel comprising a single block dimensioned to fit inside a the ends of the beam having 1) a side hole, threaded for receiving a bolt, entering a side of the block and stopping within, and 2) a top hole entering the top of the block and exiting the bottom of the block.

* * * * *